US005509327A

United States Patent [19]

Cropley

[11] Patent Number: 5,509,327

[45] Date of Patent: Apr. 23, 1996

[54] WINCH HANDLE

[75] Inventor: Geoffrey D. Cropley, New South Wales, Australia

[73] Assignee: Titan Australia Pty Limited, New South Wales, Australia

[21] Appl. No.: 400,279

[22] Filed: Mar. 3, 1995

Related U.S. Application Data

[63] Continuation of Ser. No. 30,155, filed as PCT/AU92/00256, May 25, 1992, abandoned.

[30] Foreign Application Priority Data

May 27, 1991 [AU] Australia ..... PK6347

[51] Int. Cl.[6] ..... G05G 1/00

[52] U.S. Cl. ..... 74/545; 74/557; D8/309

[58] Field of Search ..... 74/543–548, 557; D8/309, 359; D19/74

[56] References Cited

U.S. PATENT DOCUMENTS

| | | | |
|---|---|---|---|
| D. 292,550 | 11/1987 | Jackson | 74/545 X |
| D. 305,544 | 1/1990 | Ganter | D8/309 |
| D. 328,173 | 7/1992 | Nelson | D8/359 X |
| D. 336,233 | 6/1993 | Zimmermann | D8/309 |
| 2,290,815 | 7/1942 | Ruppel | 74/545 |
| 2,336,082 | 12/1943 | Floraday | 74/545 |
| 3,988,946 | 11/1976 | Gonzalez | D8/309 X |
| 4,338,827 | 7/1982 | Hooker | 74/557 X |
| 4,534,240 | 8/1985 | Dietz et al. | 74/545 |

FOREIGN PATENT DOCUMENTS

| | | | |
|---|---|---|---|
| 1190262 | 4/1965 | Germany | 74/545 |
| 2216823 | 10/1973 | Germany | 74/545 |
| 3238739 | 4/1984 | Germany | 74/545 |
| 450892 | 7/1936 | United Kingdom | 74/545 |

*Primary Examiner*—Vinh T. Luong
*Attorney, Agent, or Firm*—Abelman, Frayne & Schwab

[57] ABSTRACT

A handle has an elongate recessed body portion having internal reinforcing elements, the recessed body portion being of open-faced "U" shaped configuration when viewed in transverse cross-section, the open-faced elongate recessed body portion being closed and sealed by a cover, for the body portion to provide a sealed buoyancy chamber.

11 Claims, 5 Drawing Sheets

WINCH HANDLE

This application is a Continuation application under 37 C.F.R. 1.62 of prior application Ser. No. 08/030,155, filed as PCT/AU92/00256, May 25, 1992, now abandoned.

BACKGROUND OF THE PRESENT INVENTION

This invention relates to a winch handle and in particular to a floatable or buoyant handle.

Up until this time handles have been used for the operation of winches for a variety of purposes. It is however particularly common to use winch handles on winches used on marine craft such as boats, sailing craft, yachts and the like. These will be hereinafter referred to as "marine craft". In using winch handles on marine craft, it is known, and relatively common, to use releasable winch handles which are able to be releasably locked into engagement with winches on such marine craft; in particular this is the case, where different winches on a marine craft require operation over a relatively short period of time—for example, in the case of sailing craft, when a sailing craft is "going about". Certainly it is relatively common in marine craft to provide one or more releasably engageable winch handles which are continually engaged with and disengaged from winches, and which are also kept or stored in appropriate pockets, recesses and the like in the marine craft when they are not in use. It will be appreciated therefore that there is always a risk that such winch handles will become lost overboard, such as to sink and to be lost.

Winch handles known and used up until this time are usually constructed of a relatively strong metal material or other relatively heavy material, having properties of strength and rigidity. Thus, when lost overboard, or dropped into the water, they will sink so as to be generally irretrievable. Generally the winch handles known and used up until this time have been relatively expensive. Thus, the loss is an expensive exercise in so far as replacement is concerned. Further, during operation or use of a marine craft, the use of one or more winches can be important to the operation and indeed safety of the marine craft and the crew or people on board. Thus, the loss of one or more winch handles during operation or use of a marine craft can cause substantial inconvenience and indeed danger.

The present invention sets out to overcome or at least minimise these problems by providing an efficient and straightforward floatable and/or buoyant winch handle.

A floatable winch handle is disclosed in U.S. Pat. No. 4,338,827. The winch handle disclosed in U.S. Pat. No. 4,338,827 is floatable, but is not considered suitable because it does not have inherent features of strength and rigidity as are inherent in the winch handle of the present invention. Further, the winch handle of the present invention is a straightforward and efficiently operable winch handle as compared with the somewhat "cumbersome" winch handle disclosed in U.S. Pat. No. 4,338,827.

It is therefore an object of the present invention to provide a straightforward and efficient floatable and/or buoyant winch handle.

Other objects of the present invention will become apparent from the following description.

SUMMARY OF THE PRESENT INVENTION

According to one aspect of this invention there is provided a winch handle including an elongate recessed body portion of a substantially open faced "U" configuration when viewed in cross-section; means being provided at or adjacent one end thereof to allow for said winch handle to be releasably engaged with a winch; means being provided at the other end of said body portion in the form of, or to be attached or connected to, grip means; reinforcing means being provided within said body portion; cover means being provided and adapted in use to sealably engage with and over said recessed body portion to form a reinforced flotation/buoyancy chamber therewithin.

BRIEF DESCRIPTION OF THE DRAWINGS

The invention will now be described by way of example only and with reference to the accompanying drawings, wherein.

DETAILED DESCRIPTION OF PREFERRED EMBODIMENTS OF THE PRESENT INVENTION

Figure 1:
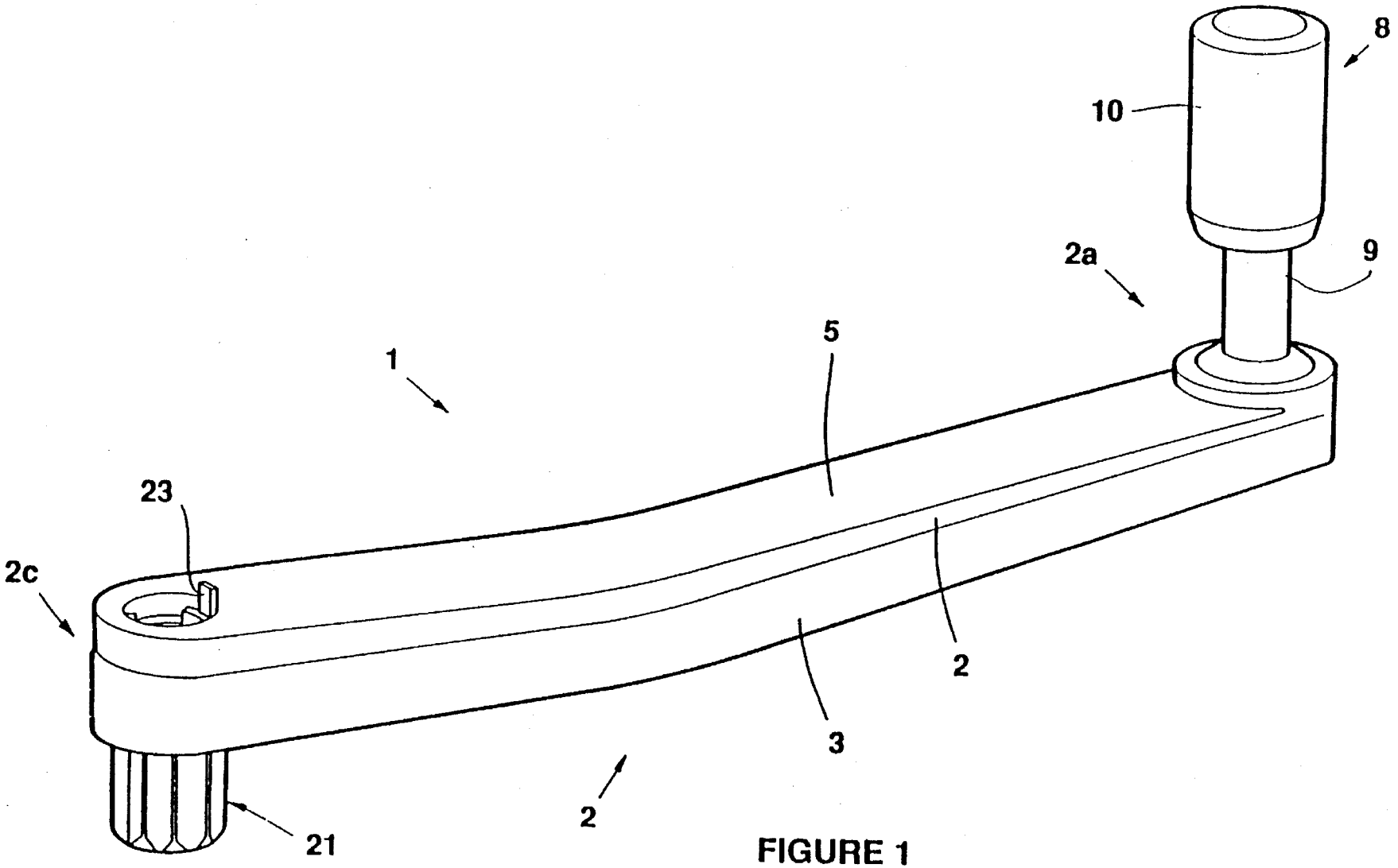
FIG. 1 is a perspective view of a winch handle according to one form of the present invention.
Figure 2:
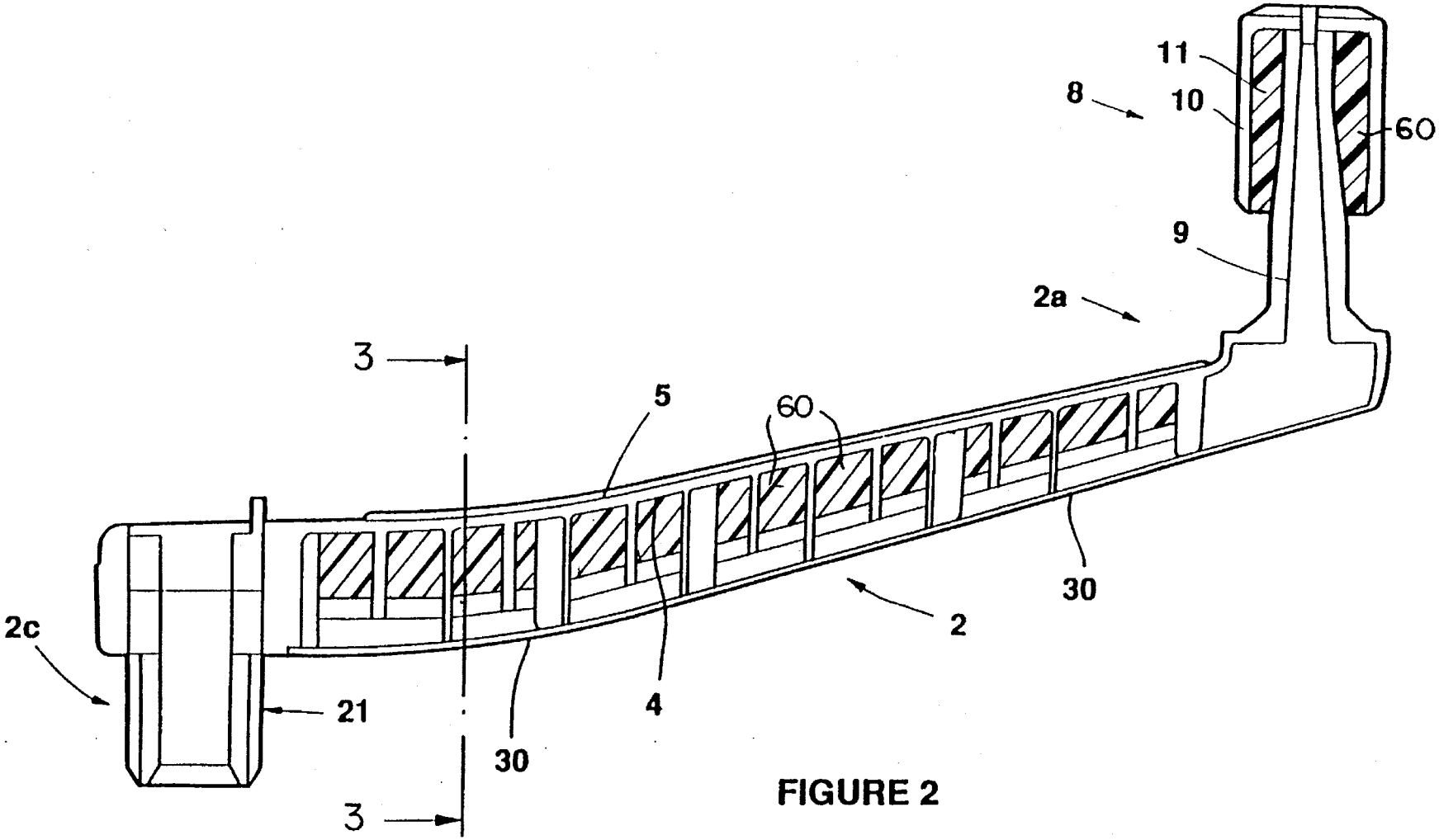
FIG. 2 is an exploded longitudinal side view of a winch handle according to one form of the invention and as generally shown in FIG. 1 of the drawings.
Figure 3:
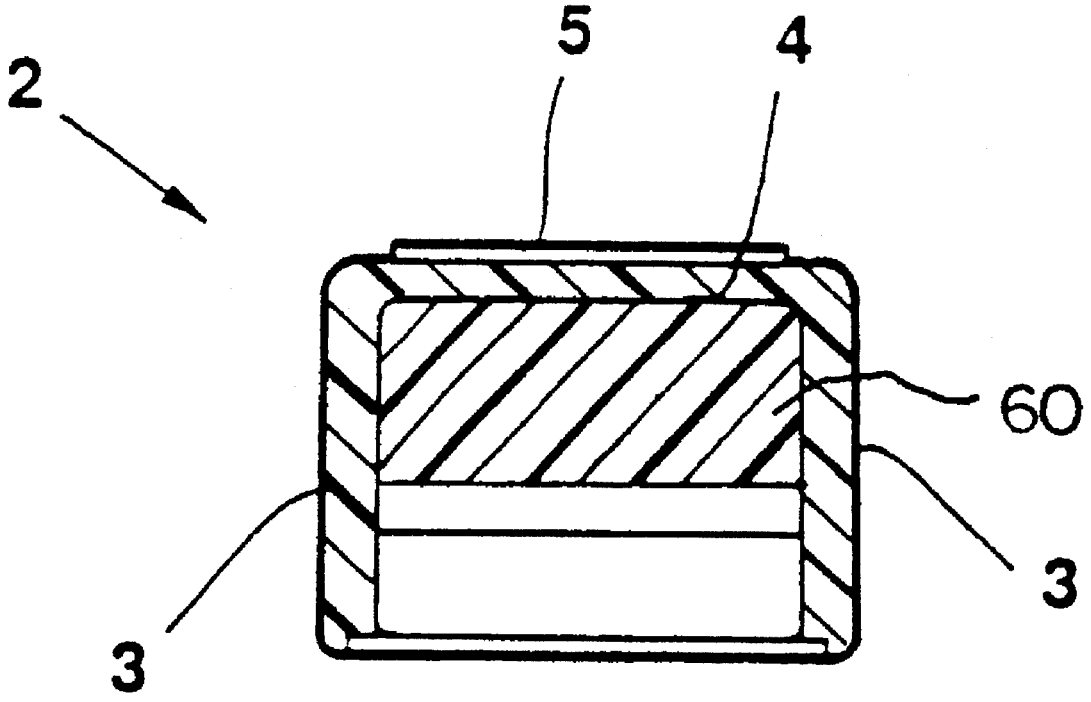
FIG. 3 is a cross-sectional view of a winch handle along lines 3—3 of FIG. 2 of the accompanying drawings.
Figure 4:
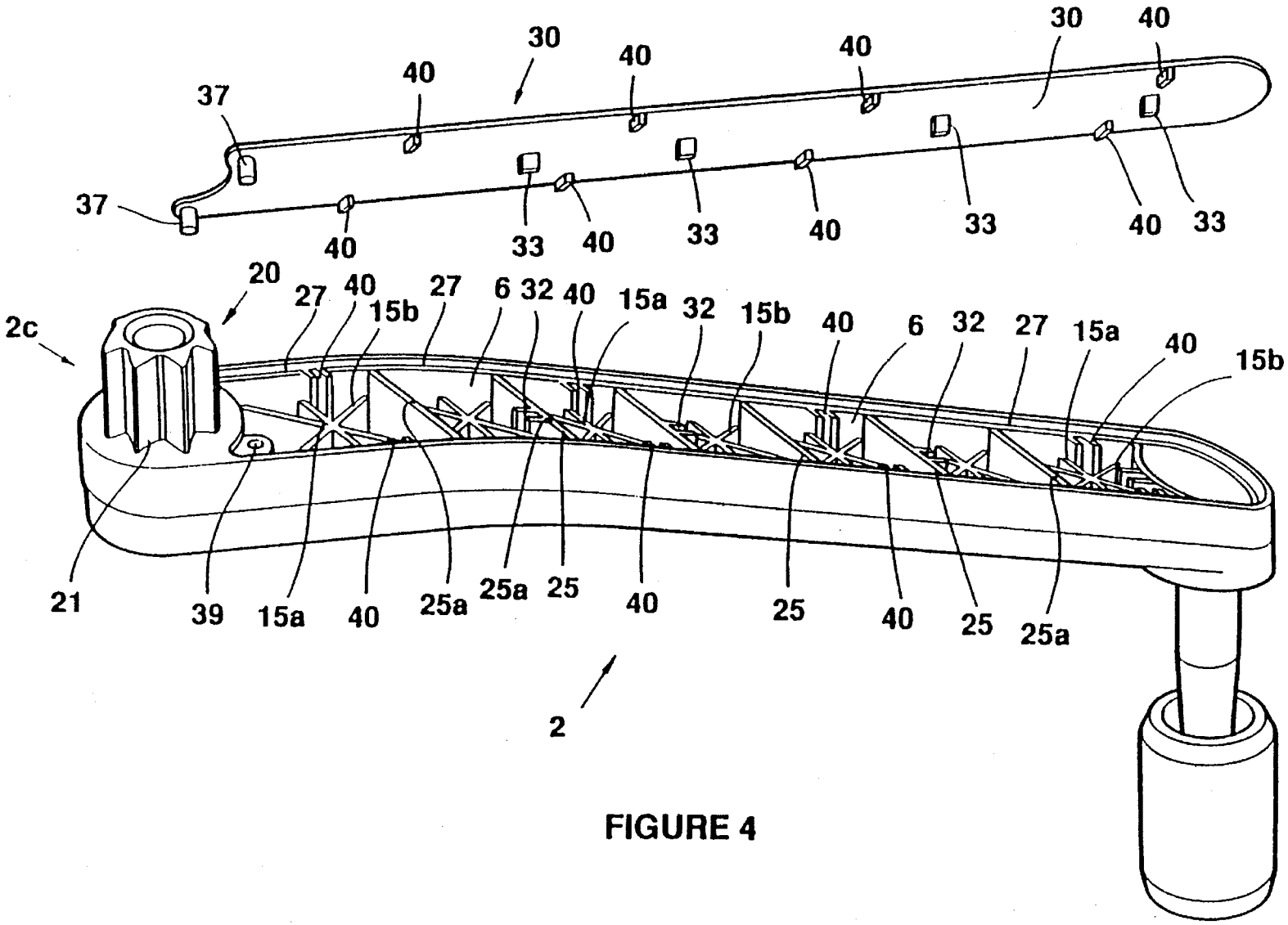
FIG. 4 is an exploded general view of a winch handle according to one form of the present invention showing the reinforced "U" body portion and cover means.
Figure 5:
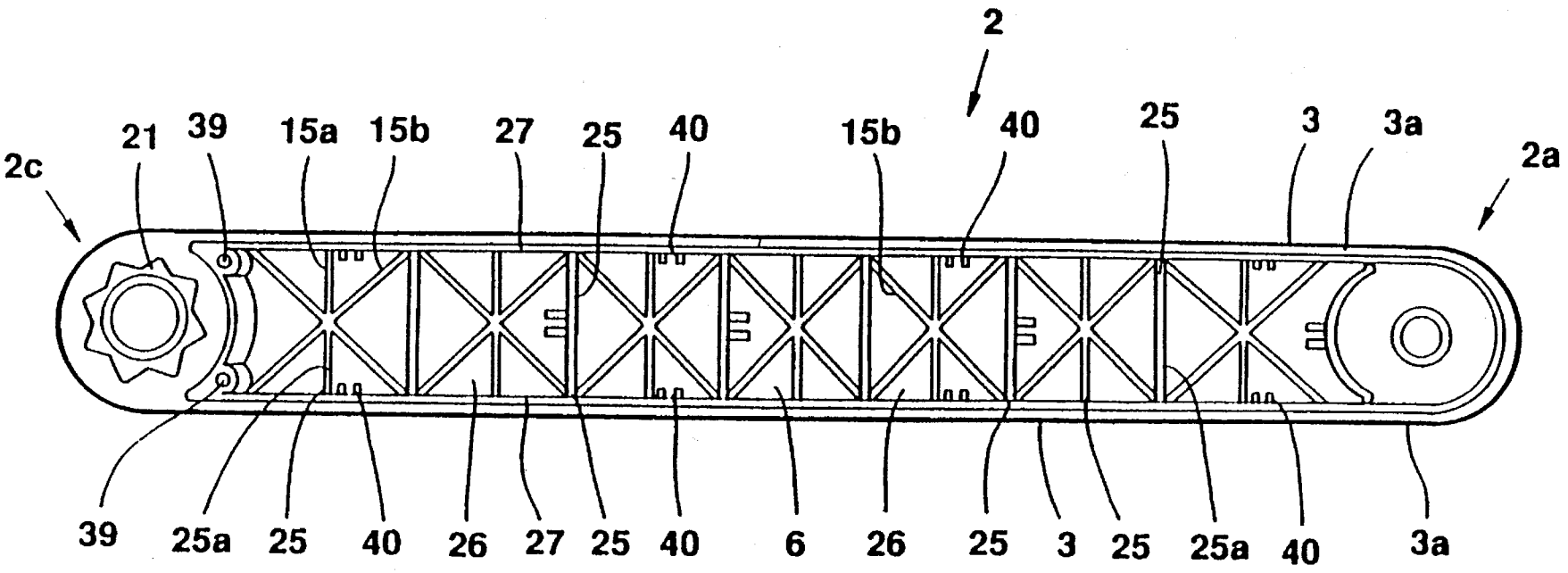
FIG. 5 is an inverted plan view of a winch handle as shown in FIG. 1 of the accompanying drawings.

This invention will now be described by way of example only with reference to the accompanying drawings. While the invention has particular application to winch handles for use with marine craft (given that the winch handle is floatable and/or buoyant), it should be appreciated that the winch handle can be used in other situations, and in connection with other winches and the like. The invention is not intended to be limited to use with marine craft or marine winches.

The winch handle 1 of the present invention is preferably formed or moulded of an appropriate plastics material such as for example a nylon plastic material suitably fiber-reinforced for strength and rigidity, or other reinforced plastics material. It should be appreciated however that the winch handle can be provided and formed of other appropriate synthetic, plastics or light-weight materials.

The winch handle 1 of the present invention includes a substantially elongate, recessed body portion 2 being of a substantially inverted "U" formation when viewed in cross-section, so as to form a recessed, elongate body portion 2. The body portion 2 has an open face 6 with outwardly extending sides 3 and a base 4. These are integrally formed or moulded one with the other. In use, and as will be appreciated from the accompanying drawings (and the following description), the open face 6 of the body portion 2 forms the underside of the winch handle 1, while the outer surface 5 of the base 4 forms the upper surface 5 of the winch handle 1. This is however by way of example only.

In a preferred form of the invention, the body portion 2 is substantially curvilinear. This is however by way of example only.

At one end 2*a* of the body portion 2 a grip means 8 is provided for gripping or holding by a user or operator of the winch handle. The grip means 8 includes an upstanding grip mounting 9 about which may be located a grip housing 10 formed of an appropriate plastics or polypropylene material. The grip housing 10 is preferably profiled to a desired shape and is attached to the end 2*a* of the body portion by moulding, bonding, clipping and the like. The grip housing 10 preferably defines a substantially hollow grip chamber 11 which, when located in place about the grip mounting 9, forms an additional or secondary flotation and/or buoyancy chamber which adds to the features of buoyancy of the winch handles. If desired, suitable sealing means (not shown) can be provided to seal the grip chamber 11. If desired, additional buoyancy material, such as for example foam plastic 60 and the like, can be inserted into the grip chamber 11 to add to the inherent buoyancy of the winch handle of the present invention.

In a further form of the invention the grip housing can be moulded or formed as a solid light plastic member.

In a further form of the invention the grip mounting 9 can be formed, or act, as a handle itself, so that there is in fact an integral handle provided at or attached to the end of the elongate body portion. In such a form of the invention the grip mounting 9 can be substantially hollow and can be capped or sealed to form a secondary flotation and/or buoyancy chamber 9*a* (filled with foam, if desired).

At the other end 2*c* of the body portion 2, means are provided to allow for the winch handle to be releasably engaged with a winch (not shown) for operation thereof. In preferred forms of the invention the engagement means 20 is in the form of a ratchet spigot member 21, such as for example a tooth spigot which is adapted to releasably engage with a winch to allow for operation thereof. Appropriate locking and release means 23 can be provided in association therewith to allow for the locking and release of the spigot 21 relative to a winch (not shown). In a preferred form of the invention the spigot 21 is formed or cast of an aluminium or metal material which has sufficient strength for use, but which is relatively light-weight. It should be appreciated however that other materials can be used.

The recessed body portion 2 of the winch 1 is formed or provided with reinforcing therein, in the form of integrally formed and moulded webs 15, being transverse webs 15*a* and angled webs 15*b*. These webs 15 are integrally formed within the recess of the body portion 2 to impart strength and rigidity to the winch handle and so as to minimise or overcome the problem of twisting when torque is applied to the handle.

In the preferred form of the invention the elongate recessed body portion 2 is provided with a plurality of spaced apart transverse divider walls 25 which divide the body portion 2 into a plurality of spaced sections 26. Within each section 26 reinforcing webs 15 (and preferably transverse and angled reinforcing webs 15*a*, 15*b*) are provided. These impart strength and rigidity to the winch handle.

The reinforcing webs 15 are of such a height as to be spaced apart from and below the upper edge surfaces 25*a* of the transverse dividing walls 25. Further, the transverse dividing walls 25 are of a height such as to be spaced apart from and below the upper edges 3*a* of the sides 3 of the body portion 2, the sides 3 of the body portion 2 being provided with a peripheral recess or step 27 on an inner surface thereof, to allow for seating and engagement of the cover means 30 (to be described hereinafter).

While the present invention is described by way of example, with reference to transverse and angled reinforcing webs 15, it will be appreciated that other configurations of webs, and indeed other forms of reinforcing can be provided in said recessed body portion 2.

In one preferred form of the invention the substantially curvilinear, elongate handle is longitudinally tapered, the side portions 3 being tapered from an area of greater height or depth at or adjacent the end 2*b* which is adapted to engage with a winch, to a lesser height or depth at or adjacent the end 2*a* at which the handle will be gripped. These are referred to as the winch engaging end and the grip end respectively.

A cover means 30 is provided in the form of an elongate cover 30 formed of an appropriate plastics material which is adapted to sealably engage over the open face 6 of the body portion 2. Preferably the elongate cover 30 is formed so as to engage within the area defined by the peripheral step 27 extending about the open face 6. At least some of the transverse divider walls 25 are provided with engaging means 32 which engage with downwardly extending lugs 33 provided on the underside of the cover 30, so that a secure engagement therebetween will engage the cover means 30 over and relative to the open-faced body portion 2. If desired, engagement means 32 can be provided on each transverse divider wall 25. Alternatively such engaging means can be provided on only some of such divider walls 25. In addition, bores or recesses 39 can be provided at each end of the body portion 2, defining the open face 6, to engage with secondary lugs 37 extending downwardly from the underside of the cover 30. In certain forms of the invention additional engagement means 40 can be provided on the inner sides of the walls 3 of the body portion 2 and depending downwardly from the underside of the cover portion 30 so as to provide additional engagement therebetween. The purpose for this is that in many forms of the invention (as will be described hereinafter), and to add additional buoyancy and/or flotation properties to the winch handle, and foam 60 (such as foam plastic) is inserted into the recess of the body portion 2 to engage therewithin and between and about the webs 15 and divider walls 25. In manufacture of the winch handle of the present invention time is required within which to allow such foam to cure. It is often necessary therefore to clamp the cover portion 30 into position with external clamps to allow for the curing of the foam. However, by providing additional engagement means (such as additional side engagement means 40) on both the body portion 2 and the underside of the cover 30, there is a strong enough engagement between the body portion 2 and the cover 30 to allow for the curing of the foam without additional clamps being necessary.

It should be appreciated however that this is not an essential feature of the invention, although it does have substantial advantages in manufacture.

In addition or as an alternative to the engagement means provided on both the body portion and the underside of the cover, the cover can be secured in position by means of bonding agents, adhesives and the like.

In one preferred form of the invention foam is inserted into the recessed body portion 2 to form within the spaced sections 26, and between and about the divider walls 25 and reinforcing webs 15*a*, 15*b*. This adds to the properties of flotation and buoyancy. If desired, however, the cover members 30 can be secured in position to maintain an air pocket within the recessed body portion. It will of course be appreciated that the webs 15 and transverse walls 25 impart substantial strength and rigidity to the winch handle. Especially this is so given the tensions to be applied thereto during use.

In one form of the invention the cover 30 can be formed or provided of a substantially transparent plastics material, so that a user can be assured of the strength and rigidity of the winch handle by viewing the webs 15 and transverse walls 25 therewithin.

The present invention therefore provides a winch handle having features of buoyancy and/or flotation which is straightforward in operation and use and which has substantial features of strength and rigidity. The winch handle has particular ,application in the areas of marine use but can also be used in conjunction with winches in other areas and industries.

The invention has been described by way of example only and it should be appreciated that modifications and improvements may be made thereto without departing from the scope of the invention as defined by the appended claims.

I claim:

1. A handle that floats in water, said handle comprising an elongate recessed body portion of an open-faced U-shaped configuration when viewed in transverse cross-section;

a cover extending over the body portion and sealing said body portion against the ingress of water, so as to form a sealed buoyancy chamber; and reinforcing means within the buoyancy chamber for reinforcing the buoyancy chamber;

said handle being provided with engaging means at a first end of the body portion for releasable engagement with a winch and a hand grip at an opposite end of said body portion.

2. The handle of claim 1, wherein the handle is curvilinear, sides of said elongate body portion being longitudinally tapered from the first end of the body portion towards the opposite end of said body portion.

3. The handle of claim 1, wherein said reinforcing means comprises transverse and angled reinforcing webs, said webs extending between inner side surfaces of the body portion.

4. The handle of claim 1, wherein said body portion is divided into a plurality of sections by transverse dividing walls which extend between inner side surfaces of the body portion; transverse and angled reinforcing webs being provided between said dividing walls.

5. The handle of claim 1, wherein the body portion and cover each include inter-engageable securing means for sealably securing the cover to the body portion so as to form the sealed buoyancy chamber.

6. The handle of claim 1, wherein the body portion includes a peripheral inwardly descending step extending about the rim of said body portion such as to allow for seating and engagement of said cover.

7. The handle of claim 1, wherein said cover is formed of a transparent plastics material.

8. The handle of claim 1, in which said grip is hollow, and is sealed closed by said cover, whereby to define an additional buoyancy chamber.

9. The handle of claim 8, wherein foam is provided within said additional buoyancy chamber in the hand grip.

10. The handle of claim 1, wherein foam is provided within the buoyancy chamber.

11. The handle of claim 1, wherein the cover is provided with a plurality of spaced apart projections adapted to be received and retained by correspondingly shaped engagement means provided on the body portion.

* * * * *